US012290185B2

(12) United States Patent
Connell et al.

(10) Patent No.: US 12,290,185 B2
(45) Date of Patent: May 6, 2025

(54) CONVERTIBLE SOOTHING INFANT SEAT

(71) Applicant: Chiaro Technology Limited, London (GB)

(72) Inventors: David Connell, London (GB); Elise Rebecca Filleul, London (GB); Poppy Farrugia, London (GB); Edward Sims, London (GB); Bernadette Deere, London (GB)

(73) Assignee: Chiaro Technology Limited, London (GB)

( * ) Notice: Subject to any disclaimer, the term of this patent is extended or adjusted under 35 U.S.C. 154(b) by 0 days.

(21) Appl. No.: 18/446,233

(22) Filed: Aug. 8, 2023

(65) Prior Publication Data

US 2024/0041225 A1 Feb. 8, 2024

(30) Foreign Application Priority Data

Aug. 8, 2022 (GB) ..... 2211542

(51) Int. Cl.
*A47D 11/00* (2006.01)
*A47D 9/02* (2006.01)
*A47D 13/10* (2006.01)

(52) U.S. Cl.
CPC ..... *A47D 11/005* (2013.01); *A47D 9/02* (2013.01); *A47D 13/107* (2013.01)

(58) Field of Classification Search
CPC ..... A47D 11/005; A47D 9/02; A47D 13/107; B60R 22/06; B60R 22/08
USPC ..... 5/93.2
See application file for complete search history.

(56) References Cited

U.S. PATENT DOCUMENTS 2,587,121 A 2/1952 Deardorff et al.
3,054,591 A * 9/1962 Cohn ..... A47D 13/107 248/419
3,331,632 A * 7/1967 Lerner ..... A47D 13/107 297/302.4

(Continued)

FOREIGN PATENT DOCUMENTS

CA 3173448 A1 9/2021
CN 204368233 U 6/2015

(Continued)

OTHER PUBLICATIONS

Combined Search and Examination Report in GB2211541.4, dated Feb. 3, 2023, 5 pages.

(Continued)

*Primary Examiner* — Justin C Mikowski
*Assistant Examiner* — Luke Hall
(74) *Attorney, Agent, or Firm* — Sterne, Kessler, Goldstein & Fox P.L.L.C.

(57) ABSTRACT

A convertible soothing seat for an infant is provided. The convertible soothing seat includes a support frame and a seat portion pivotably connected to the support frame. The seat portion is pivotable between a soothing configuration and a sleep-safe configuration, and includes a retractable harness. The retractable harness covers a portion of the seat portion in a covering position when the seat portion is in the soothing configuration and retracts to a retracted position wherein the retractable harness does not cover the portion of the seat portion when the seat portion is in the sleep-safe configuration.

24 Claims, 11 Drawing Sheets

(56) References Cited

U.S. PATENT DOCUMENTS 3,359,035 A * 12/1967 Schiffman ..... A47D 1/002 297/343
4,139,131 A * 2/1979 Hathaway ..... A47D 15/006 224/160
4,141,095 A 2/1979 Adachi
4,181,356 A * 1/1980 Fleischer ..... A47D 1/10 248/370
4,205,406 A * 6/1980 Wangkeo ..... A47D 9/02 5/98.1
4,344,649 A * 8/1982 Fleischer ..... B62B 7/123 297/30
5,342,113 A 8/1994 Wu
6,257,070 B1 7/2001 Giallorenzo et al.
6,869,368 B1 * 3/2005 Clarke ..... A47D 13/107 297/256.16
6,896,331 B2 * 5/2005 Kassai ..... A47D 1/002 297/229
7,347,089 B1 3/2008 Kelley et al.
8,316,490 B1 * 11/2012 Bilak ..... A47D 5/006 5/655
8,708,832 B2 4/2014 Gilbert et al.
8,784,227 B2 7/2014 Speedie
9,629,476 B1 * 4/2017 Robbins ..... A47D 9/02
10,106,187 B1 10/2018 Farrar et al.
2002/0002741 A1 * 1/2002 Tomas ..... A47D 9/02 5/101
2002/0113469 A1 * 8/2002 Stern ..... A47D 1/10 297/256.16
2003/0069079 A1 4/2003 Kelly et al.
2007/0205646 A1 9/2007 Bapst et al.
2007/0262627 A1 11/2007 Clapper et al.
2008/0255503 A1 10/2008 Quackenbush et al.
2008/0271243 A1 * 11/2008 Burkholder ..... A47D 9/016 5/93.2
2009/0062622 A1 3/2009 Lin
2009/0284050 A1 * 11/2009 Myers ..... A47D 1/10 297/118
2009/0284058 A1 * 11/2009 Gillett ..... A47D 13/107 297/258.1
2010/0062917 A1 * 3/2010 Nanna ..... A47D 13/107 482/142
2012/0181830 A1 * 7/2012 Gooris ..... A47D 13/102 297/250.1
2013/0026805 A1 1/2013 Sclare et al.
2013/0214567 A1 * 8/2013 Miller ..... A47D 13/107 297/256.13
2014/0068859 A1 * 3/2014 Alegria ..... A47D 13/10 5/655
2015/0082539 A1 * 3/2015 Lin ..... A47D 11/005 5/101
2015/0289678 A1 * 10/2015 Vinje Brustad ..... A47D 1/002 297/258.1
2015/0342368 A1 * 12/2015 Corso ..... A47D 9/053 297/354.12
2016/0174728 A1 * 6/2016 Karp ..... A61M 21/02 5/655
2016/0183695 A1 6/2016 Veron
2016/0304004 A1 * 10/2016 Sandbothe ..... G05D 1/0016
2016/0345751 A1 12/2016 Mountz et al.
2017/0340285 A1 11/2017 Rubin et al.
2018/0325280 A1 * 11/2018 Paperno ..... A47D 9/02
2019/0059611 A1 2/2019 Burns et al.
2019/0135323 A1 * 5/2019 Avigdor ..... B62B 7/12
2019/0247611 A1 8/2019 Karp et al.
2019/0335916 A1 * 11/2019 Taylor ..... A47D 9/02
2019/0374044 A1 * 12/2019 Acevedo ..... A47D 1/004
2021/0077673 A1 3/2021 Mason et al.
2023/0117090 A1 * 4/2023 Mountz ..... A47D 15/00 297/217.3
2023/0263316 A1 8/2023 Herrin et al.
2023/0338630 A1 10/2023 Claassen et al.
2023/0404290 A1 12/2023 Nottage

FOREIGN PATENT DOCUMENTS

CN 113080655 A 7/2021
CN 216135540 U 3/2022
DE 102014200790 A1 8/2014
EP 3549843 A1 10/2019
EP 4000661 A1 5/2022
GB 2163045 A 2/1986
GB 2511915 A 9/2014
WO WO-2015118652 A1 8/2015

OTHER PUBLICATIONS

Combined Search and Examination Report in GB2211542.2, mailed on Jan. 25, 2023, 7 pages.
International Search Report and Written Opinion for Application No. PCT/EP2023/071935, mailed on Oct. 26, 2023, 8 pages.
International Search Report and Written Opinion for Application No. PCT/EP2023/071966, mailed on Oct. 26, 2023, 9 pages.
International Search Report and Written Opinion for Application No. PCT/EP2024/053348, mailed on Jul. 15, 2024, 15 pages.

* cited by examiner

CONVERTIBLE SOOTHING INFANT SEAT

CROSS-REFERENCE TO RELATED APPLICATIONS

The present application claims priority to GB Application No. 2211542.2, filed Aug. 8, 2022, the entirety of which is incorporated herein by reference.

TECHNICAL FIELD

The present disclosure relates to a convertible infant seat and, in particular, to an infant seat which may be convertible into a sleep-safe form.

BACKGROUND

A soothing infant seat, such as a bouncer, is a seat which may be reclined and may be suitable to securely support an infant and provide a soothing motion, for example a rocking or bouncing motion. A soothing seat may be set in motion by manually rocking the seat while the structure of the soothing seat is configured to allow the rocking or bouncing motion to continue for a short time without further manual input. Some soothing seats may be electrically driven by way of an electric drive mechanism without the requirement for manual input.

A soothing infant seat may require an inclined or bowed shape in order to support the baby's weight underneath but also hold the baby's head up for observation and interaction. Since there is a risk that the baby might fall from the front of the seat in the inclined position and/or from the bouncing motions, a soothing infant seat may include some form of secure support or harness to hold the baby in position in the seat.

A bassinet is a bed typically used for babies from 0 to 6 months (although could feasibly be used for older babies) and may include a flat surface for the baby to sleep on and should be free of obstructions or loose blankets or pillows which could represent a risk to the baby. Sudden Infant Death Syndrome (SIDS) is a little understood cause of infant death which usually occurs during sleep. Whilst the exact cause of SIDS is unknown, it is highly recommended that for sleep, a baby is laid to rest on their back on a horizontal flat firm mattress and free from obstruction and loose bedding. Where a bassinet or cot meets these, and other, requirements the bassinet may be described as sleep-safe. For safety, a parent should not leave an infant alone to sleep in a non-sleep-safe environment for any extended period of time. This can present a problem to a parent who has successfully soothed an infant to sleep in a soothing seat because the inclined position of the soothing seat is not safe for sleep and the infant cannot be left unattended. In order to be able to leave the infant to sleep, the parent would need to transfer the infant to a sleep-safe environment first which poses a risk of disturbing the infant's sleep or even waking the infant. The present disclosure provides for a convertible soothing seat which may allow a parent to convert the soothing seat into a sleep-safe configuration without the need to transfer the infant to another environment, or otherwise disturb them

SUMMARY

In a first aspect there is provided a convertible soothing infant seat for an infant comprising a support frame, a seat portion pivotably connected to the support frame, wherein the seat portion may be configured to actuate between a soothing configuration and a sleep-safe configuration. Since the convertible soothing infant seat can actuate between the soothing configuration and the sleep-safe configuration, in use an infant may be allowed to continue sleeping after falling asleep in the soothing configuration but the convertible soothing seat may be made sleep-safe. For example, once the infant has fallen asleep in the soothing configuration, the infant does not need to be removed or awoken from the convertible soothing seat in order to make the convertible soothing seat sleep-safe.

In a further aspect, there is provided the convertible soothing seat, wherein the seat portion may comprise a bottom support portion and a back rest portion pivotably coupled such that the back rest portion may be rotated relative to the bottom support portion between a flat configuration and a bowed configuration.

In a further aspect, there is provided the convertible soothing seat, wherein the seat portion may comprise a support and a membrane stretched over the support.

By converting the seat portion between a flat configuration and a bowed configuration, the surface on which the infant is resting may be changed between providing proper support to the infant's spine in the bowed position to providing a flat surface which is safe for the infant to sleep on for an extended period.

Additionally, the convertible soothing seat may further comprise a tensioner configured to tension the membrane in a flat configuration wherein the membrane is held flat by the tension, and wherein the tensioner is configured to release the membrane in a bowed configuration wherein the membrane may conform to the shape of the support; or wherein the convertible soothing seat further comprises a support actuating element configured to actuate the support between a first position in which the membrane is held flat by conforming to the support and a second position, the second position being further from the membrane than in the first position, in which the membrane may flex to a concave shape.

In a further aspect, there is provided the convertible soothing seat, wherein the seat portion may be configured to transition from the bowed configuration to the flat configuration in response to the seat portion being actuated from the soothing configuration to the sleep-safe configuration. Where the seat portion transitions from the bowed configuration to the flat configuration automatically and/or in response to the seat portion being actuated from the soothing configuration to the sleep-safe configuration, the sleeping surface may be automatically made sleep-safe without requiring the infant to be picked up, woken up, or otherwise disturbed.

In a further aspect, there is provided the convertible soothing seat, wherein the seat portion may be configured to transition from the flat configuration to the bowed configuration in response to the seat portion being actuated from the sleep-safe configuration to the soothing configuration. Conversely, by transitioning from the bowed configuration to the flat configuration automatically, the convertible soothing seat requires fewer actions from a parent to make the soothing seat safe for use in soothing.

In a further aspect, there is provided the convertible soothing seat, wherein the seat portion may comprise a handle, such that the seat portion may be manually pivoted between the soothing configuration and the sleep-safe configuration.

In a further aspect, there is provided the convertible soothing seat, wherein in the soothing configuration the seat portion may be inclined, and in the sleep-safe configuration the seat portion may be substantially horizontal with respect to the support frame.

In a further aspect, there is provided a convertible soothing seat, wherein the seat portion may comprise a retractable harness.

In a further aspect, there is provided the convertible soothing seat, wherein the retractable harness may be configured to cover a portion of the seat portion in a covering position when the seat portion is in the soothing configuration and to retract to a retracted position wherein the retractable harness does not cover the portion of the seat portion when the seat portion is in the sleep-safe configuration. It will be understood that by retracting the retractable harness, the harness will be removed from the occupant area of the convertible soothing seat when in the sleep-safe configuration ensuring that the occupant area is safe for an infant to sleep in.

Additionally, the retractable harness may be configured to retract in response to the actuation of the seat portion from the soothing configuration to the sleep-safe configuration. By retracting in response to the actuation of the seat portion from the soothing configuration to the sleep-safe configuration, the seat portion may be made sleep-safe without disturbing an infant in use. In particular, the retractable harness may be dangerous to a sleeping infant and so it is not considered to be sleep-safe for extended periods of time and/or unattended. Furthermore, the convertible soothing seat may be made sleep-safe with a greatly reduced number of actions. By reducing the number of actions a sleeping infant is less likely to be awoken and the convertible soothing seat may be made sleep-safe without waking the infant.

Additionally or alternatively, the retractable harness may be configured to actuate from the retracted position to the covered position in response to the actuation of the seat portion from the sleep-safe configuration to the soothing configuration.

In a further aspect, there is provided the convertible soothing seat, wherein the seat portion may further comprise at least one sidewall.

In a further aspect, there is provided the convertible soothing seat, wherein the seat portion may comprise a sidewall which extends about a circumference of the seat portion.

Additionally or alternatively, the sidewall may be movable between a lowered position wherein the sidewall either does not extend above the seat portion or extends a short distance above the seat portion, and a raised position wherein the sidewall extends a greater distance above the seat portion than in the lowered position.

Further additionally or alternatively, the sidewall may comprise a rim and a sidesheet, and wherein the sidesheet is stowed in or under the rim such that the rim may contain or cover a portion of the sidesheet.

Additionally, the rim may comprise a roller around which a portion of the sidesheet is wrapped.

Further additionally, the roller may be rotatable to retract the sidesheet into the rim. By applying rotation to the roller the sidesheet may be retracted or let out to alter the height of the sidewall.

In a further aspect, there is provided the convertible soothing seat, wherein the seat portion may be configured to be manually actuated between the soothing configuration and the sleep-safe configuration.

In a further aspect, there is provided the convertible soothing seat, wherein the seat portion may be lockable in one or both of the soothing configuration and the sleep-safe configuration such that when the seat portion is locked it is prevented from being manually actuated between the soothing configuration and the sleep-safe configuration.

In a further aspect, there is provided the convertible soothing seat, wherein the soothing seat may comprise an actuator coupled to the seat portion and configured to actuate the seat portion between the soothing configuration and the sleep-safe configuration. By actuating the seat portion between the soothing configuration and the sleep-safe configuration by means of an actuator, the convertible soothing seat may be made sleep-safe without manual user input which may risk waking a sleeping infant.

In a further aspect, there is provided the convertible soothing seat, wherein the actuator may comprise one or more of an electric motor, a drive screw, a pneumatic actuator, or a hydraulic actuator.

Additionally or alternatively, the convertible soothing seat may further comprise a controller coupled to the actuator and configured to control actuation of the seat portion between the soothing configuration and the sleep-safe configuration in response to an input.

Further optionally, the input may comprise one or more of a monitoring condition of the seat portion from a camera, a movement sensor, a weight sensor, a microphone, and/or a temperature sensor, a time condition, or a user controlled input. Where the input is monitoring the state of the seat portion, the room, or the infant from the input, the one or more sensors may provide an automatic transition from a soothing configuration to the sleep-safe configuration. By utilising such an input, for example, the convertible soothing seat may automatically convert to be sleep-safe in response to determining that the infant has fallen asleep.

In a further aspect, there is provided the convertible soothing seat, wherein in the soothing configuration and the sleep-safe configuration the seat portion may extends away from the support frame, and wherein the convertible soothing seat may further be configured to be actuated to a storage and transport configuration in which the seat portion is collapsed with the support frame.

In a further aspect, there is provided the convertible soothing seat, wherein the seat portion may be configured to actuate between a soothing configuration and a sleep-safe configuration without removing the infant from the seat portion in use.

In a further aspect, there is provided the convertible soothing seat, further comprising an electronic communication module wherein the electronic communication module may be configured to communicate with a connected device such that the connected device may be used to control operation of the convertible soothing seat.

In a further aspect, the electronic communication module may be one of a wireless communication protocol module, Bluetooth or WiFi module, or a wired communication or usb module and the connected device is one or a smartphone, a tablet, or a personal computer.

BRIEF DESCRIPTION OF THE DRAWINGS

Specific embodiments are described below by way of example and with reference to the accompanying drawings in which.

DETAILED DESCRIPTION

Figure 1:
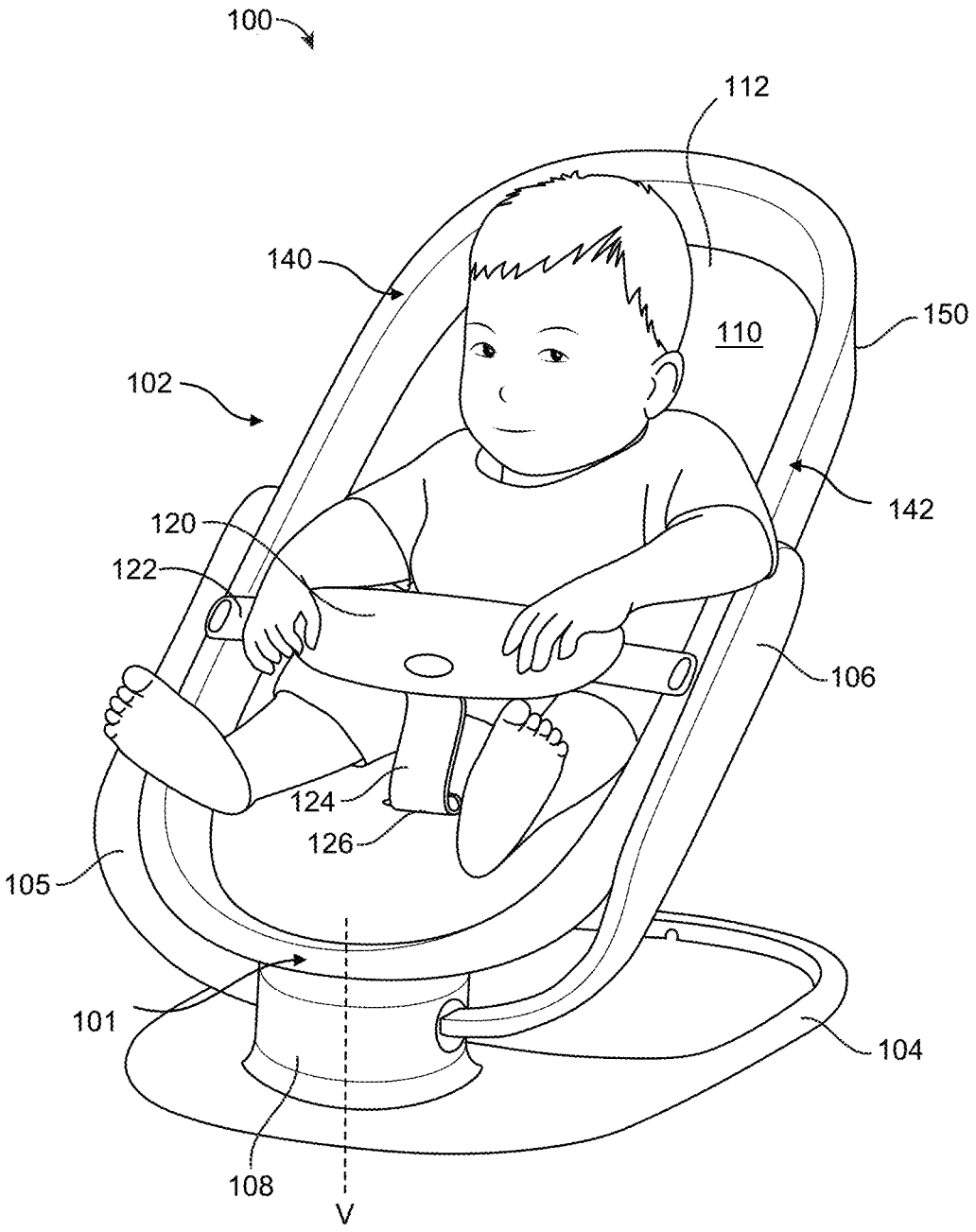
FIG. 1 shows a convertible soothing seat in a soothing configuration wherein the seat portion is inclined, according to an embodiment of the invention.

With reference to FIG. 1, there is shown a convertible soothing seat 100 according to an embodiment of the invention. The convertible soothing seat 100 includes a seat portion 102 and a support frame 106. The seat portion 102 is pivotably connected to the support frame 106. In the embodiment shown in FIG. 1, the seat portion 102 is pivotably connected to the support frame 106 at the midpoint of the seat portion 102. The support frame 106 may comprise a pin or rod, and the seat portion 102 may comprise a corresponding slot. The pin or rod may be received in the corresponding slot to form a pivoting joint and therefore the pivotal connection. Alternatively, the support frame 106 may comprise the slot and the seat portion 102 may comprise the pin or rod to form the pivotal connection. In alternative embodiments the seat portion 102 may be pivotably connected to the support frame 106 at parts of the seat portion 102 other than the midpoint. For example, the seat portion 102 may be connected to the support frame 106 at or near an end 101 of the seat portion 102.

When used herein, the term seat portion encompasses the portion of the convertible soothing seat 100 on which an infant will be laid or seated. In a bowed configuration a seat portion might resemble a typical chair or seat in that the support to the infant is concave. In this way, a bowed seat portion will provide correct support to the infant's spine but allow the infant to be sat up. Since the soothing seat is convertible to a sleep-safe configuration, the seat portion may also be flat. In this way the seat portion would resemble a bed or a mattress in such a way that a flat horizontal sleeping surface is provided. The seat portion may include removable or fixed cushioning, one or more fabric layers, and one or more support elements (such as a concave or flat support or frame) to provide a bowed configuration and a flat configuration.

The support frame 106 may comprise a base portion 104 which is configured to support the convertible soothing seat 100 on the floor, ground, or other flat surface. The support frame 106 may also comprise one or more arms 105 connecting the seat portion 102 to the base portion 104. The one or more arms 105 are pivotably, or slidably connected to the seat portion 102 and may be rigidly or movably connected to the base portion 104. In the situation where the arms 105 are movably connected to the base portion 104, the base portion 104 may comprise a hinge 108 or flex joint to articulate the seat portion 102.

The seat portion 102 is configured to cradle or securely hold an infant in use. To cradle an infant, the seat portion 102 comprises a support surface 110 which may be concave with respect to an infant in use. Concavity of the support surface 110 may be achieved by providing a support surface 110 comprising a bottom support portion and a backrest portion pivotably coupled together. When the infant is to be cradled, the bottom support portion and the back rest portion may be pivoted or rotated relative to one another to create a bowed configuration in which the support surface 110 is concave.

Figure 2A:
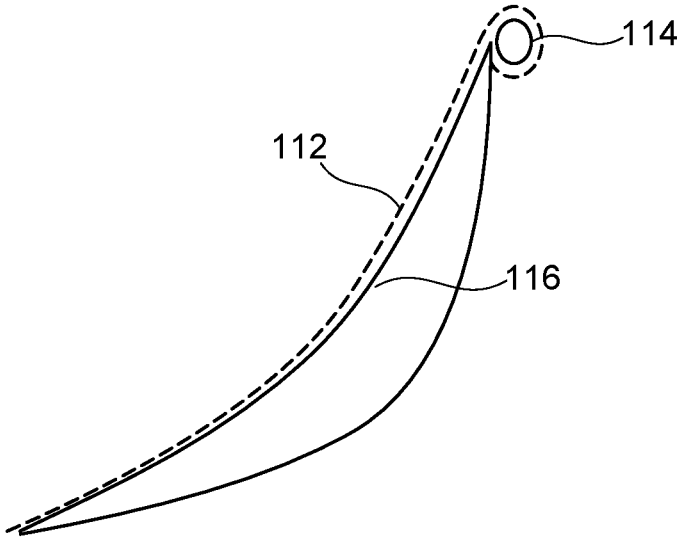
FIG. 2*a* shows a schematic of a seat portion in a bowed configuration by use of a membrane over a structural support according to an embodiment of the invention.
Figure 2B:
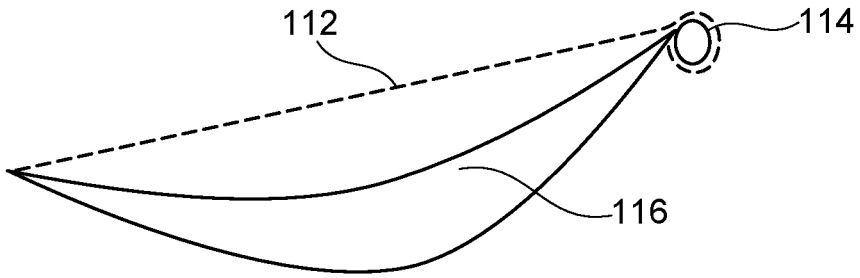
FIG. 2*b* shows a schematic of the seat portion of FIG. 2*a* in a flat configuration by use of a membrane tensioned over the structural support according to an embodiment of the invention.

Alternatively, and as shown in FIG. 1, the support surface 110 may comprise a concave support covered by a tensionable membrane 112. The tensionable membrane 112 may be formed from a fabric sheet and optionally includes padding 113 or a stiff fabric material. FIGS. 2*a* and 2*b* show a diagram indicating how a tensionable membrane 112 may be tensioned or stretched by a tensioner 114. FIG. 2*a* shows a bowed configuration in which the membrane 112 is released from tension by the tensioner 114. In the bowed configuration, and due to the lack of tension in the membrane 112, the membrane 112 may conform to the shape of a concave support 116. The membrane 112 may conform to the shape of the concave support 116 under its own weight, non-tensioned, or uncompressed form, or it may be configured to conform to the shape of the concave support 116 under the additional weight of an infant placed on the membrane 112. FIG. 2*b* shows a flat configuration in which the membrane 112 is held taut by tension provided by the tensioner 114. The skilled person will appreciate that the tensioner may be in the form of a roller configured to foreshorten the membrane 112 extending over the concave support 116, or the tensioner may include any other mechanism configured to foreshorten the membrane 112 not limited to but including an elastic mechanism or a slider connected to the membrane 112.

Figure 2C:
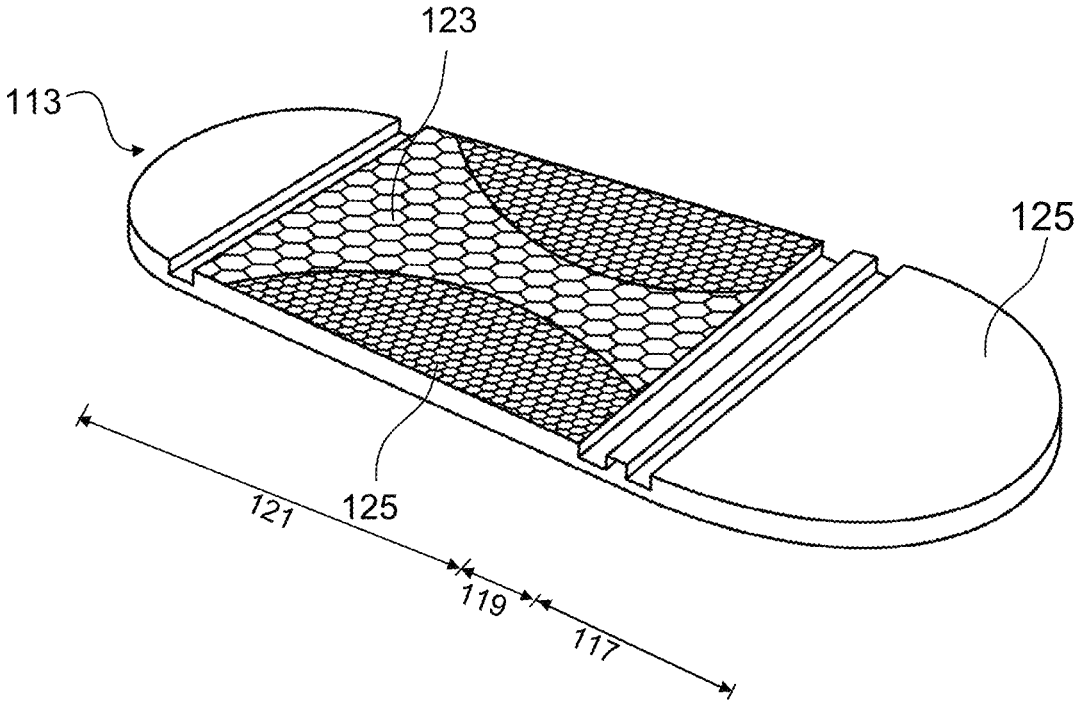
FIG. 2*c* shows a schematic of a locally stiffened tensionable membrane according to an embodiment of the invention.
Figure 2D:
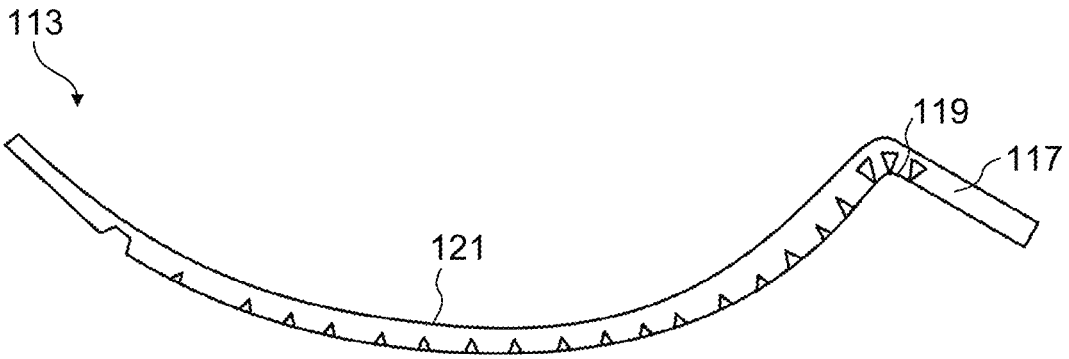
FIG. 2*d* shows a schematic of the locally stiffened tensionable membrane of FIG. 2*c* in a concave configuration.

FIGS. 2*c* and 2*d* show a padding member 113 which may be incorporated into a tensionable membrane 112 to create a composite structure, for example the tensionable membrane 112 of FIGS. 1, 2*a*, and 2*b*. The padding member 113 comprises a body 115 which may be divided into different sections. A first section 117 may be formed of a material having a first thickness and having a first stiffness. A second section 119 may have a second stiffness which is lower than the first stiffness. The second section 119 may have a lower stiffness by means of having a second thickness which is less than the first thickness or, additionally or alternatively, the second section 119 may have a lower stiffness by means of being formed of a material having a lower material stiffness or Young's modulus than the first section. Additionally or alternatively, the padding member 113 may comprise a porous section 121. Porous section 121 may be disposed between the first section 117 and the second section 119. The porous section 121 may comprise a foam or a honeycomb structured material thereby providing a locally reduced stiffness. The porous section 121 may further be divided into a first porous section 123 and a second porous section 125. The first porous section 123 may comprise a first porous or honeycomb structured material having a first porosity or cell size and the second porous section 125 may comprise a second porous or honeycomb structured material having a second porosity or cell size wherein the first porosity or cell size is different from the second porosity or cell size. In this way, the first porous section 123 and the second porous section 125 may be tuned so as to provide a locally stiffened padding member 113 which may conform to a concave seat shape in use. For example, as shown in FIG. 2*c*, the second porous section 125 has a smaller cell size than the first porous section 123. The second porous section 125 is located around an edge of the padding member 113 whereas the first porous section 123 is located along a central axis of the padding member 113. In this way the first porous section 123 may provide a gradually curved concave shape, whereas the second porous section 125 may provide a stiff side support to hold an infant in use. FIG. 2*d* shows the padding member 113 of FIG. 2*c* sectioned in profile and displaying the concave shape of the padding member 113 created by locally tuned stiffness of the second section 119 and the porous section 121.

Figure 2E:
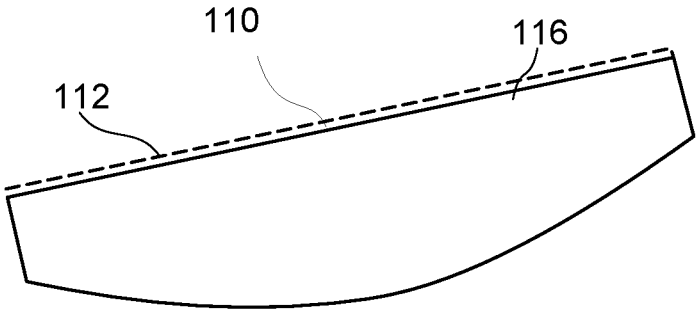
FIG. 2*e* shows a schematic of a seat portion in a flat configuration by use of a membrane support by a flat support.
Figure 2F:
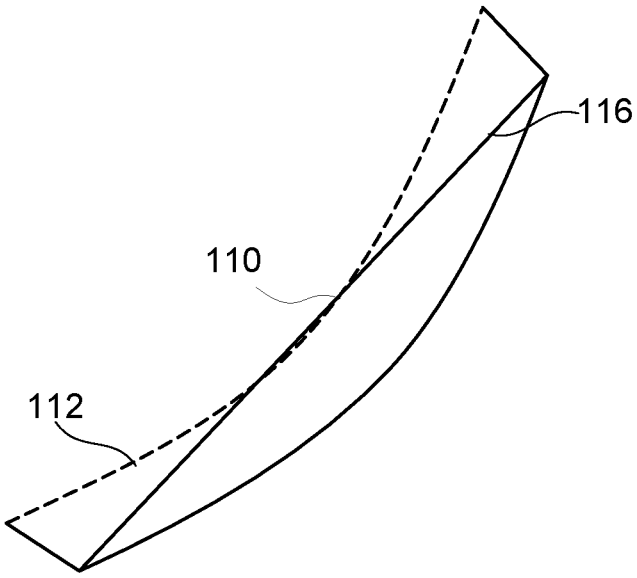
FIG. 2*f* shows a schematic of the seat portion of FIG. 2*e* in a bowed configuration by use of a membrane unsupported by the flat support.

As shown in FIGS. 2*e* and 2*f*, the support surface 110 may comprise a substantially flat support covered by a membrane 112. The membrane 112 may be formed from fabric sheets multiple panels, and optionally includes a padding member or a stiff fabric material such as to create a concave geometry. The membrane 112 may comprise the padding member 113 as described above in reference to FIGS. 2*c* and 2*d*. FIG. 2*e* shows a flat configuration in which the membrane 112 is supported from below by the support 116. When the substantially flat support 116 is in contact with the membrane 112 the membrane 112 conforms to the flat support 116 providing a flat and level sleep-safe surface. FIG. 2*f* shows a bowed configuration in which the flat support 116 is retracted away from the membrane 112 allowing the membrane to curve or sag under its own weight and/or the weight of an infant in the seat portion 102.

With reference to FIG. 1, the convertible soothing seat 100 further includes a retractable harness 120. The retractable harness 120 includes one or multiple lap straps 122 which extends laterally across the seat portion 102 and optionally a crotch strap 124 extending from the centre of the lap strap 122 and connected to the seat portion 102 at a connection point 126. Further optionally, the retractable harness 120 may include one or two shoulder straps (not shown) configured to extend over the infant's shoulders in use and secure the infant in the convertible soothing seat 100. As shown in FIG. 1, the retractable harness 120 is configured to secure an infant in the seat portion 102. In this way, the convertible soothing seat 100 may be moved or bounced, or an infant may move around or wriggle without risk of the infant being ejected from the seat portion 102.

Figure 3:
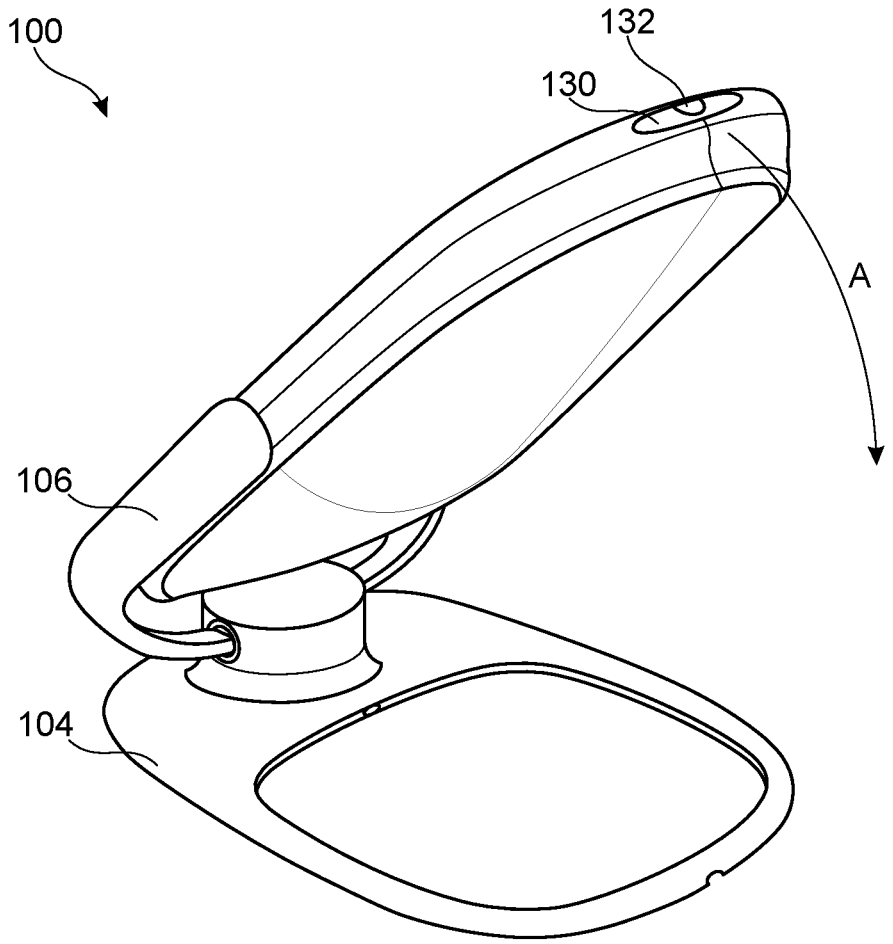
FIG. 3 shows a convertible soothing seat being rotated from a soothing configuration to a sleep-safe configuration according to an embodiment of the invention.
Figure 4:
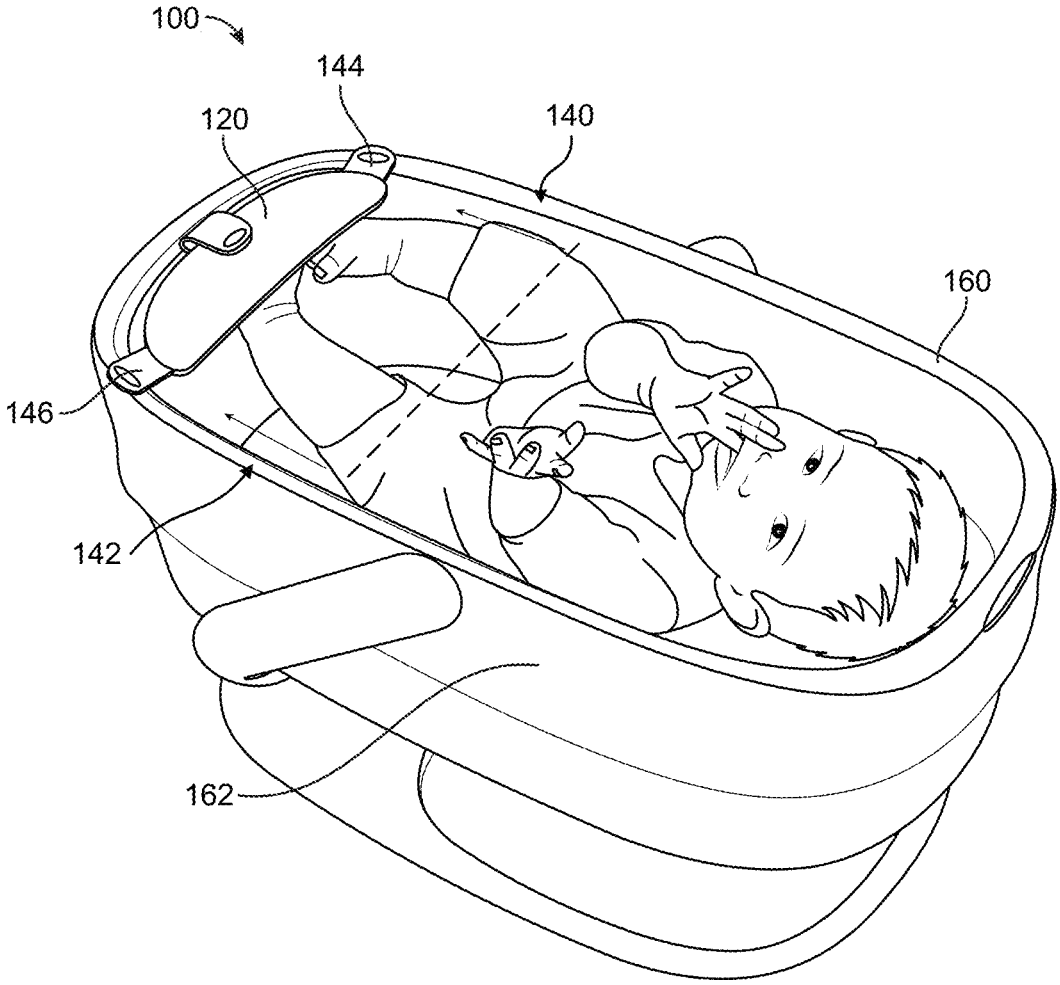
FIG. 4 shows a convertible soothing seat in a sleep-safe configuration wherein the retractable harness has been retracted according to an embodiment of the invention.

With reference to FIG. 3, according to an embodiment of the invention, the convertible soothing seat 100 may be actuated in the direction of arrow A from the soothing configuration shown in FIGS. 1 and 3 into the sleep-safe configuration shown in FIG. 4. Once in the sleep-safe configuration of FIG. 4, the seat portion 102 may be actuated in a reverse direction from the sleep-safe configuration to the soothing configuration. The seat portion 102 may comprise a handle 130 which a parent may use to manually pivot the seat portion between the soothing configuration of FIG. 3 and the sleep-safe configuration of FIG. 4. The seat portion may further comprise a button 132 which is configured to lock and unlock the seat portion in one or both of the soothing configurations and the sleep-safe configurations. For example, when the seat portion is in one of the soothing configurations and the sleep-safe configurations a position lock (not shown) may retain the seat portion in that configuration. Activation of the button 132 may unlock the position lock and allow the parent to manually actuate the seat portion 102 from one of the soothing configuration and the sleep-safe configuration to the other configuration. Alternatively, the button 132 may comprise an electrical switch connected to a power source, a controller, and a motor and arranged to automatically actuate the seat portion 102 between the soothing and the sleep-safe configurations. Further alternatively, the button 132 may be located on other positions of the convertible soothing seat and/or the button 132 may be replaced with any suitable style of actuator, for example a lever.

Whilst actuation of the convertible soothing seat 100 between a soothing configuration and a sleep-safe configuration is described, the convertible soothing seat 100 may additionally be locked into one or more intermediate positions, for example but not limited to an upright position at no more than 50 degrees from horizontal in one embodiment, between zero and 50 degrees from horizontal in some embodiments, or at 10 degree steps between a 15 and 45 degree angle from horizontal in other embodiments. Alternatively, the convertible soothing seat 100 may be infinitely adjustable to any intermediate position by means of a continuous sliding lock mechanism. Such additional intermediate positions may be more suited to new-born infants as opposed to older infants, for example.

When the seat portion 102 is actuated (either manually or automatically) from the soothing configuration to the sleep-safe configuration the seat portion 102 may transition from the bowed configuration to the flat configuration in response. In one example, wherein the seat portion comprises a bottom support portion and a back rest portion pivotably coupled together, the back rest portion may rotate from a first inclined position to a horizontal position and the bottom support portion may rotate from a second inclined position to a horizontal position wherein the first inclined position is more inclined than the second inclined position. To put it another way, the back rest portion and the bottom support portion may form a chair in the soothing position and automatically flatten when the seat portion 102 is actuated from the soothing configuration to the sleep-safe configuration. In another example, actuation of the seat portion 102 from the soothing configuration to the sleep-safe configuration may activate the tensioner to tension the membrane to provide a flat sleep-safe surface in the sleep-safe configuration. Actuation of the seat portion 102 from the sleep-safe configuration to the soothing configuration may inversely actuate the bottom support portion, the back rest portion, and/or the tensioner to return the seat portion 102 to the bowed configuration.

Herein, the term horizontal refers to an orientation substantially perpendicular to gravity by means of the support frame. For example, the support frame may include a base which has a ground contact portion. In use, the ground contact portion defines the horizontal plane because the ground contact portion will typically be placed flat on the ground. As shown in FIG. 1, the ground contact portion of the support frame 104 is the underside of the support frame 104 which will contact the ground. The support frame 104 supports the seat portion 102 such that the ground plane is normal to the vertical axis V. The ground may also be shown with reference to FIG. 5 in which the ground is normal to the vertical axis V. The skilled person will appreciate that a ground contact portion placed on an inclined surface will result in a convertible soothing seat which is not completely perpendicular to the direction of gravity but the sleep-safe configuration of the seat portion 102 will remain substantially horizontal with respect to the support frame.

With reference to FIG. 4, according to an embodiment of the invention, the retractable harness 120 may be configured to actuate between a covering position (as shown in FIG. 1) and a retracted position (shown in FIG. 4). In the covering position, the retractable harness 120 covers a portion of the seat portion 102. The lap strap 122 may extend laterally across the seat portion 102 from one side edge 140 to an opposing side edge 142. The lap strap 122 may be adjustable to accommodate infants over a range of sizes. The lap strap 122 may cover a portion of the seat portion 102 and provide a space between the lap strap 122 and the seat portion 102 for an infant to occupy. The lap strap 122 may be connected to the side edge 140 by a first connection element 144. The lap strap 122 may also be connected to the opposing side edge 142 by a second connection element 146. The first connection element 144 and the second connection element 146 may each be movably coupled to the side edge 140 and the opposing side edge 142 respectively. For example, the first connection element 144 and the second connection element 146 may be slidably received within a corresponding slot or rail disposed in each of the side edge 140 and the opposing side edge 142. In this way, the lap strap 122 and/or the harness 120 may slide from a covering position to a retracted position. The straps which form the harness 120 may be conventional straps or they may be formed of a solid structure including fasteners, or some other flexible or padded structure. Additionally, any of the straps may be covered by a strap cover to provide a soft interface for the infant. Whilst the lap strap 122 is shown as a single strap, the lap strap 122 may be formed of two or more portions configured to connect together to form the lap strap 122. For example, the lap strap 122 may be formed of a first half and a second half which may separately retract into their respective connection points 144, 146 and secure together. The first half and the second half of the lap strap 122 may additionally be biased such that they move away from the infant in use or otherwise retract when the first half and the second half are detached from one another.

The retractable harness 120 may further comprise a crotch strap 124 extending from a midpoint of the lap strap 122. When the retractable harness 120 is in the covering position, the crotch strap 124 may be connected to the connection point 126 on the seat portion 102. The crotch strap 124 may be configured to retract when the retractable harness 120 is moved from the covering position to the retracted position. For example, the crotch strap 124 may be selectively connected to the connection point 126 by means of a releasable connector (seatbelt style connector, or plastic clip connector). Further, the crotch strap 124 may be configured to be stowed or retracted. For example, the crotch strap may be contained in a retractable reel, retract through a mattress covering the seat portion, or the crotch strap may be retained in a strap or pouch on the lap strap 122. Hence, when the retractable harness 120 is moved from the covering position to the retracted position, the crotch strap 124 may be removed from obstructing the sleep-safe area of the seat portion 102 when the seat portion 102 is in the flat configuration.

The seat portion 102 of the convertible soothing seat 100 may further comprise a sidewall 150. The sidewall 150 may be formed from a solid or flexible material. The sidewall 150 may be formed of a transparent, partially transparent, or opaque material. By providing a transparent material the sidewall will allow light to pass through and the infant may be observed through the sidewall 150. The sidewall 150 extends about a circumference of the seat portion 102, although the sidewall 150 may only extend around a portion of the circumference of the seat portion 102. For example, the sidewall 150 may extend around the entire circumference of the seat portion 102, or it may comprise only a side edge 140 and an opposing side edge 142. As shown in FIG. 1, when the seat portion 102 is in the soothing configuration, the sidewall 150 at least partially surrounds the seat portion 102. The sidewall 150 extends around the circumference of the seat portion 102 and extends above the seat portion 102 or away from the seat portion 102 such that the sidewall 150 provides a barrier to the seat portion 102. Alternatively, the sidewall 150 may extend around the circumference of the seat portion 102 but not extend away from the seat portion 102 such that the sidewall does not provide a barrier to the seat portion 102 in the soothing configuration.

Figure 5:
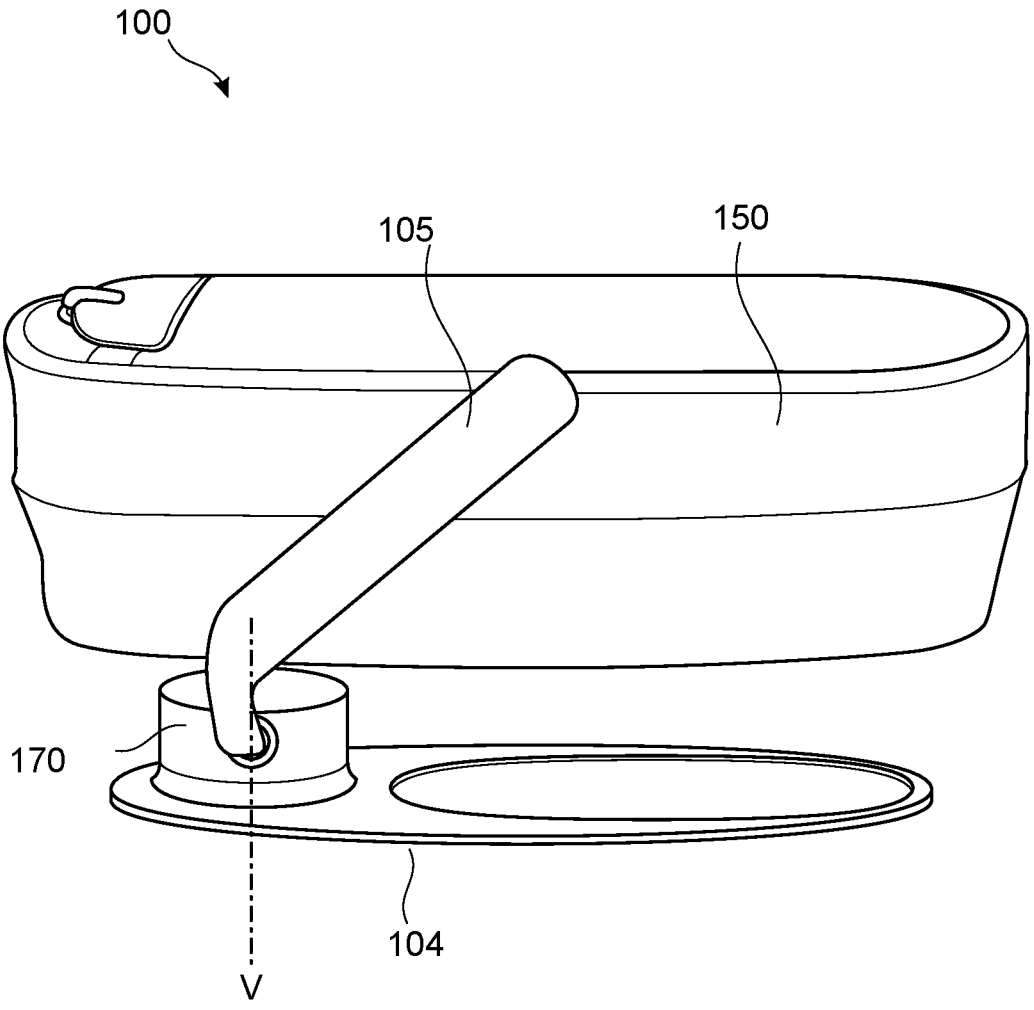
FIG. 5 shows a convertible soothing seat in a sleep-safe configuration according to an embodiment of the invention.

With reference to FIGS. 3 and 4, when the seat portion 102 is actuated from the soothing configuration (the soothing configuration is the configuration as shown in FIGS. 1 and 3) to the sleep-safe configuration (the sleep-safe configuration is the configuration as shown in FIGS. 4 and 5), the sidewall 150 is configured to move from a lowered position (as shown in the soothing configuration in FIG. 3) wherein the sidewall either does not extend above the seat portion or only extends a short distance above the seat portion, to a raised position (as shown in the sleep-safe configuration in FIG. 4) wherein the sidewall 150 extends above the seat portion 102 a greater distance than in the lowered position. In this way, the sidewall 150 may be extended to provide a suitable barrier in the sleep-safe configuration and may be retracted or lowered to provide access in the soothing configuration.

The sidewall 150 may comprise a rim 160 and a sidesheet 162. The sidesheet 162 may be stretched over the rim 160 to create the barrier around the circumference of the seat portion 102. The sidesheet 162 may be formed of a pliable fabric such that it can be retracted into the rim 160 and the rim 160 may contain a portion of the sidesheet 162. In this way, the sidewall 150 may be in the lowered position when the sidesheet 162 is at least partially contained in the rim 160 and the sidewall 150 may be in the raised position when the sidesheet 162 is unfurled from the rim 160. The rim 160 may comprise a roller around which the sidesheet 162 is wrapped. Rotating the roller may effect retraction and unreeling of the sidesheet 162 to move the sidewall 150 between the raised and lowered positions. Alternatively, the sidewall 150 may comprise two or more telescoping portions such that the sidewall 150 may be collapsed into the lowered position and extended into the raised position.

A sidewall 150 may comprise a rim and a sidesheet 162. The sidesheet 162 may be stretched over and connect the rim 160, and the seat portion 102 to form a sidewall. As the rim 162 and seat portion 102 pivot from inclined to flat, or flat to inclined position via separate pivot points placed along the support 106, the normal distance between the seat portion 102 and sidewall 162 increases or decreases, in effect raising or lowering the side sheet to create, or remove a wall relative to the seat portion.

The sidesheet may be composed of an elastic material, such that as the rim and seat portion move apart the fabric is pulled to create a structured wall. Additionally, the material may be pleated, or contain localised rigid sections to encourage the collapse and extension in a uniform and neat manner.

FIG. 5 shows an embodiment of the invention where the convertible soothing seat 100 where the seat portion 102 has been actuated into the sleep-safe configuration, the sidewall 150 has been raised, and the retractable harness 120 has been retracted. In this configuration, the seat portion 102 is sleep-safe. This is because the seat portion 102 is flat, the sidewall 150 provides an adequately high barrier, and the retractable harness 120 has been removed from covering the seat portion 102 (i.e. there is no obstruction in the sleep area). The skilled person will appreciate that an adequately high barrier would be such that an infant in the convertible soothing seat 100 would be secure. More specifically, the sidewall 150 may be raised to 7.5 inches (190.5 mm), at least 7.5 inches (190.5 mm), or more than 7.5 inches (190.5 mm).

As the person skilled in the art will appreciate, a soothing motion may be preferred in the soothing configuration but in the sleep-safe configuration it may be preferred that the convertible soothing seat 100 is not so readily movable so as to promote sleep. In the sleep-safe configuration shown in FIG. 5, the convertible soothing seat 100 may therefore be configured so as to resist bouncing. The one or more arms 105 are connected to the base 104 via a plinth 170. The plinth 170 may be rotatably coupled to the base 104 and rotatable in use about a vertical axis V. The rotation of the plinth 170 may be controlled in an elastic manner about a centre point such that rotation or swinging of the convertible soothing seat may continue for an extended period of time once a user has stopped imparting rotation or swinging motions on the convertible soothing seat 100. For example, a spring or other elastic element may be connected between the base 104 and the plinth 170 such that the convertible soothing seat will rotatably oscillate around the vertical axis V.

Additionally, or alternatively, the one or more arms 105 may be flexibly or elastically mounted in the plinth 170 such that when a bouncing or rocking motion is imparted on the convertible soothing seat 100, the convertible soothing seat 100 may bounce up and down or rock side to side. Additionally, or alternatively, the one or more arms 105 may be formed from a resilient material (for example but not limited to steel) such that the one or more arms 105 may resiliently deflect under load to generate a bouncing or oscillating motion.

One or both of the bouncing motion and the rotation (or swinging) motions may be selectively controlled by means of a lockout. The lockout includes an indent or detent, or other locking mechanism, configured to rigidly couple the arms 105 to the plinth 170 and/or the plinth 170 to the base 104. The lockout may be located inside the plinth 170. The lockout may be activated automatically by actuation of the seat portion 102 from the soothing configuration to the sleep-safe configuration. In this way, when the convertible soothing seat 100 is in the soothing configuration bouncing and/or swinging motions may be readily imparted on the convertible soothing seat 100 and when the convertible soothing seat is in the sleep-safe configuration, the convertible soothing seat resists any imparted bouncing and/or swinging motions.

Additionally or alternatively, rotation/swinging or bouncing motions may be continually be imparted on the seat portion 102 by means of an electromechanical system. The electromechanical system may include an electric motor or actuator, a drive screw, a pneumatic actuator or a hydraulic actuator. The electromechanical system may be configured to rotate the plinth 170 about the vertical axis V in an oscillating motion and/or rotate the one or more arms 105 in the plinth 170 in an oscillating and bouncing motion. Alternatively to a continual rotation/swinging or bouncing motion, the electromechanical system may be configured to impart a gradually diminishing motion (i.e. reducing in amplitude of the motion) until the motion has stopped.

Figure 12:
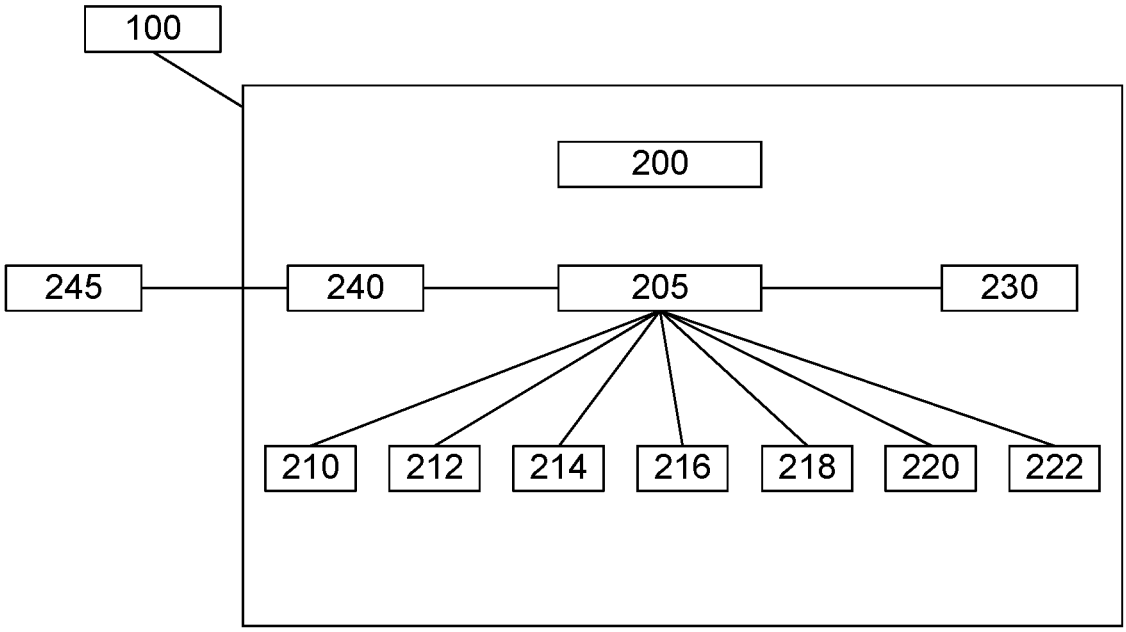
FIG. 12 shows a block diagram of exemplary components of a convertible soothing seat according to an embodiment of the invention.

FIG. 12 shows a block diagram of exemplary components of the convertible soothing seat 100 according to some embodiments. The convertible soothing seat 100 may be manually actuated between the soothing configuration and the sleep-safe configuration, or the convertible soothing seat 100 may comprise an actuator 200 in the form of an electric motor, a drive screw, a pneumatic actuator, or a hydraulic actuator configured to transform the seat portion 102 between the soothing configuration and the sleep-safe configuration. The actuator 200 is coupled to a controller 205 which may control the actuator 200 to move the seat portion 102 between the soothing configuration and the sleep-safe configuration. The controller 205 may be in communication with one or more sensors for monitoring the condition of the convertible soothing seat 100. For example, the one or more sensors may comprise position sensors which provide an electrical signal to the controller 205 to indicate whether the seat portion 102 is in the soothing configuration or in the sleep-safe configuration. The one or more sensors may additionally or alternatively comprise a sensor for monitoring the condition of the seat portion 102 by means of a camera 210, a movement sensor 212, a weight sensor 214, a microphone 216, or a temperature sensor 218. In this way, the controller 205 may be configured to actuate the convertible soothing seat 100 from the soothing configuration to the sleep-safe configuration based on a monitored condition of the infant in the seat portion 102. For example, the controller 205 may be configured to automatically make the seat portion 102 sleep-safe in response to determining that the infant has fallen asleep. The controller 205 may be configured to actuate the seat portion 102 between the soothing configuration and the sleep-safe configuration in response to an input comprising a time condition 222 or a user controlled input 230. For example, the controller 205 may be configured to actuate the seat portion 102 from the soothing configuration to the sleep-safe configuration after a predetermined time has elapsed. As another example, the controller 205 may be configured to actuate the seat portion 102 from the soothing configuration to the sleep-safe configuration in response to a user button press of a button on the convertible soothing seat 100 or a user button press of a button on a remote control, or a user button press in the graphical user interface of a remote connected device 245 such as a smartphone or tablet in communication with the controller 205 through an electronic communication module 240.

Figure 6:
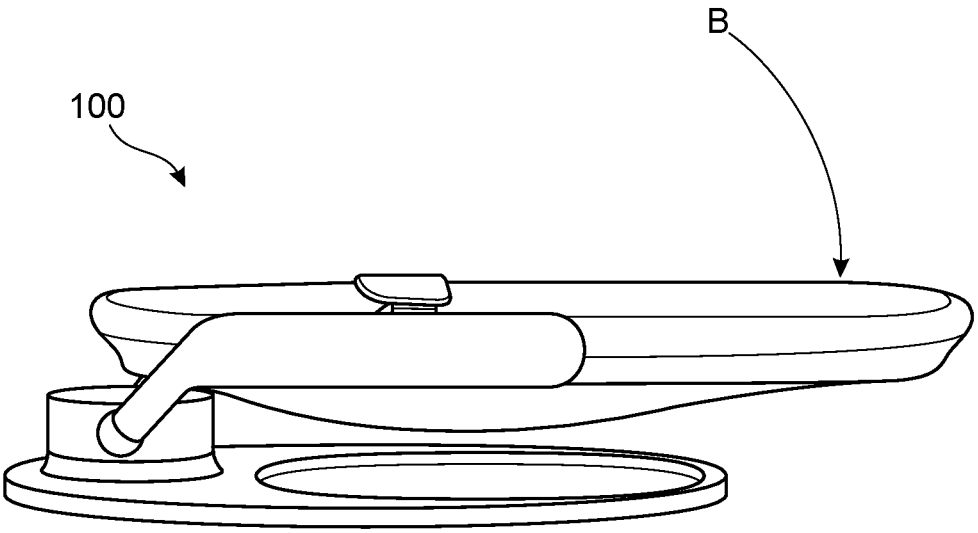
FIG. 6 shows a convertible soothing seat in a storage configuration according to an embodiment of the invention.
Figure 7:
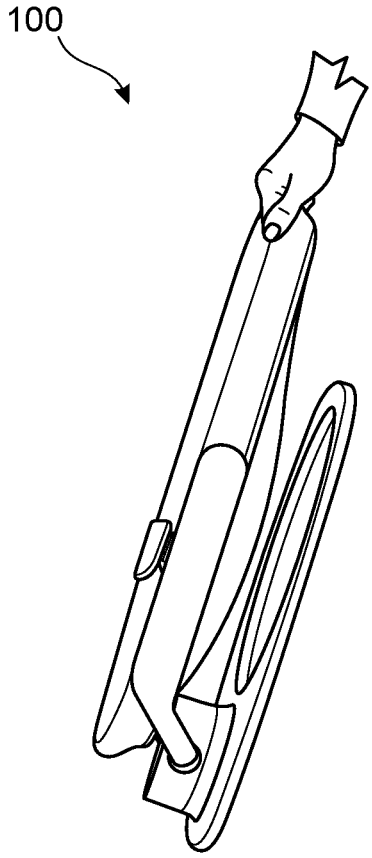
FIG. 7 shows a convertible soothing seat in a storage configuration according to an embodiment of the invention.

With reference to FIGS. 6 and 7, according to an embodiment of the invention, the convertible soothing seat 100 may further be converted into a storage configuration. As shown in FIG. 6, the seat portion 102 may be rotated relative to the base 104 from the soothing configuration into the storage configuration. However, instead of the seat portion 102 being rotated at the coupling between the one or more arms 105 and the seat portion 102, the seat portion is rotated in the direction B and about the coupling between the one or more arms 105 and the plinth 170 connected to the base 104. As shown in FIG. 7, the storage configuration provides a more compact layout of the seat portion 102 and the base 104 and the sidewall 150 is in a lowered position.

Figure 8:
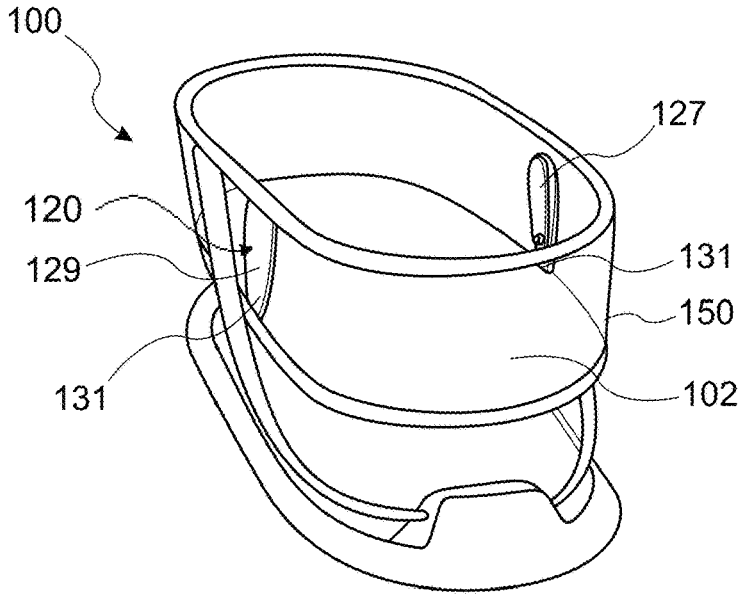
FIG. 8 shows a convertible soothing seat in a sleep-safe configuration with stowed straps according to an embodiment of the invention.

FIGS. 8 to 11 show a retractable harness 120 according to a further embodiment of the invention. FIG. 8 shows the soothing seat 100 wherein the seat portion 102 in a sleep-safe configuration. In the sleep-safe configuration, the retractable harness 120 is in a retracted position such that the retractable harness does not encroach on the seat portion 102 where an infant may be sleeping. The retractable harness 120 comprises a first lap strap 127 and a second lap strap 129. The first lap strap 127 and the second lap strap 129 are disposed on opposite sides of the seat portion 102. In a biased position the first lap strap 127 and the second lap strap 129 extend vertically or upright away from the seat portion 102. The first lap strap 127 and the second lap strap 129 may each comprise a biasing member 131, for example a spring or a leaf spring, which is configured to bias each of the respective first lap strap 127 and the second lap strap 129 into the vertical or upright position.

Figure 9:
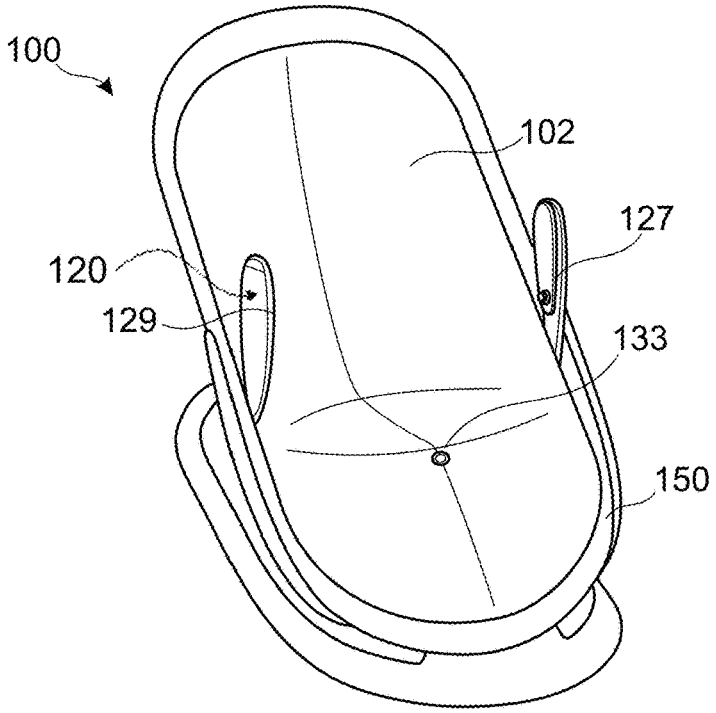
FIG. 9 shows a convertible soothing seat in a soothing configuration with stowed straps according to an embodiment of the invention.

FIG. 9 shows the soothing seat of FIG. 8 wherein the seat portion 102 is in the soothing configuration. As will be appreciated, the first lap strap 127 and the second lap strap 129 are each biased into the vertical or upright position by means of each respective biasing member 131. When the seat portion 102 is in the soothing configuration, the first lap strap 127 and the second lap strap 129 extend vertically above the seat portion 102 and above the sidewall 150. In the sleep-safe configuration shown in FIG. 8 the first lap strap 127 and the second lap strap 129 extend vertically above the seat portion 102 but do not extend vertically above the sidewall 150. In this way, in the sleep-safe configuration the first lap strap 127 and the second lap strap 129 are contained by the sidewall 150. The first lap strap 127 and/or the second lap strap 129 may be held in position contained by the sidewall 150 by one or more of integrated magnets, hook and loop fasteners, zips, or other means or retaining the strap into the sidewall 150.

Figure 10:
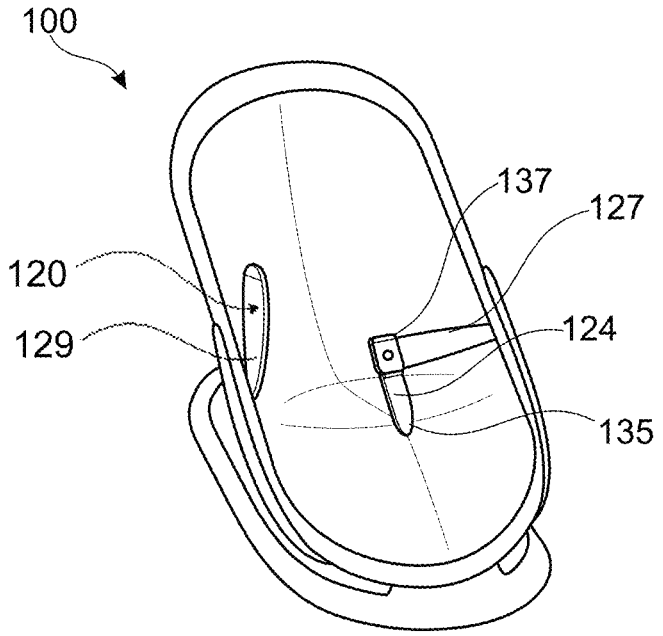
FIG. 10 shows a convertible soothing seat in a soothing configuration with one covering strap engaged according to an embodiment of the invention.

FIG. 10 shows the soothing seat 100 of FIGS. 8 and 9, still in the soothing configuration, but where the first lap strap 127 has been extended across the seat portion 102 into a covering position. The first lap strap 127 may be held in the covering position by connection with the crotch strap 124. The crotch strap 124 may be extended from the seat portion 102 where the crotch strap 124 had been retracted under a mattress (not shown) on the seat portion 102 such that the crotch strap 124 is removed from the sleep-safe area of the seat portion 102. Alternatively, the crotch strap 124 may be connected to a seat connection point 133 of the seat portion 102 via connection with a crotch strap connector 135 of the crotch strap 124. The first lap strap 127 may be connected to the crotch strap 124 by means of a first lap strap connector 137. The first lap strap connector 137 comprises a male connector and a female connector which engage to provide a releasable coupling between the first lap strap 127 and the crotch strap 124. Locating of the male and female connectors of the first lap strap connector 137 may be assisted by means of one or more magnets in the male and/or female connectors. For example, the male connector may be configured to slide into locking engagement with the female connector wherein in locking engagement a magnet holds the male and female connectors in locking engagement. It will be appreciated that the first lap strap 127 may comprise the male connector or the female connector whereas the crotch strap will comprise the other of the corresponding female connector or male connector to provide the releasable connection between the first lap strap 127 and the crotch strap 124.

Figure 11:
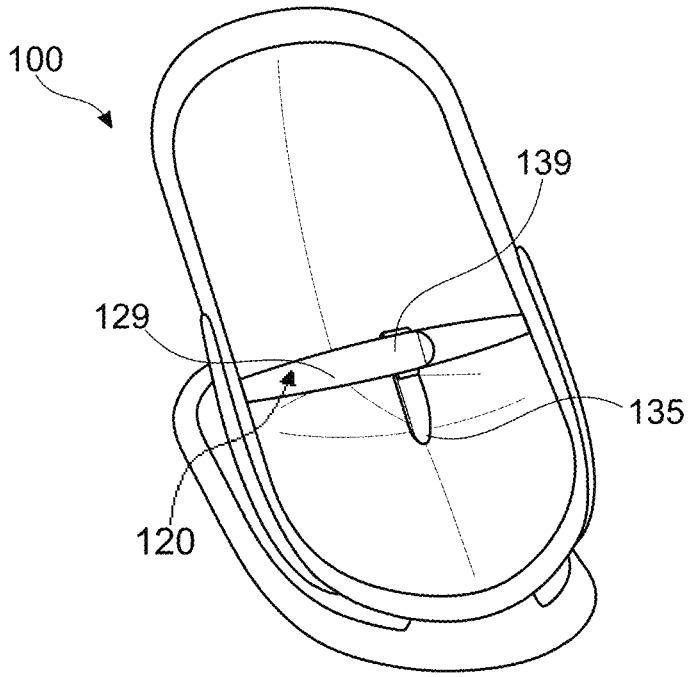
FIG. 11 shows a convertible soothing seat in a soothing configuration with all covering straps in the covering position according to an embodiment of the invention.

FIG. 11 shows the soothing seat 100 wherein the second lap strap 129 has been extended across the seat portion 102 into a covering position. The second lap strap 129 may be held in the covering position by connection with the crotch strap 124. The second lap strap 129 may be connected to the crotch strap 124 by means of a second lap strap connector 139. The second lap strap connector 139 comprises a male connector and a female connector which engage to provide a releasable coupling between the second lap strap 129 and the crotch strap 124. Locating of the male and female connectors of the second lap strap connector 139 may be assisted by means of one or more magnets in the male and/or female connectors. For example, the male connector may be configured to slide into locking engagement with the female connector wherein in locking engagement a magnet holds the male and female connectors in locking engagement. It will be appreciated that the second lap strap 129 may comprise the male connector or the female connector whereas the crotch strap 124 will comprise the other of the corresponding female connector or male connector to provide the releasable connection between the second lap strap 129 and the crotch strap 124.

The first lap strap connector 137 and the second lap strap connector 139 together provide the entire lap strap 122 releasably connected to the crotch strap 124. The lap strap 122 may be released automatically upon retraction of the crotch strap 124 into the retracted position or in response to the seat portion 102 being moved from the soothing configuration to the sleep-safe configuration. The first lap strap connector 137 and the second lap strap connector 139 may each be mechanically coupled to the crotch strap such that retraction of the crotch strap 124 causes the first lap strap connector 137 and the second lap strap connector 139 to disengage.

Alternatively, the crotch strap 124 and the first lap strap 127 may be permanently connected. The first lap strap 127 may be biased with the crotch strap 124 into the vertical position by the biasing member 131. The crotch strap may be connected to the seat portion 102 by means of the crotch strap connector 135 and the seat connection point 133 of the seat portion 102. The second lap strap 129 may be connected to the crotch strap 124 and the first lap strap 129 via the second lap strap connector 139.

The first lap strap connector 137, the second lap strap connector 139, and/or the crotch strap connector 135 may be automatically released from being connected by means of a release button or a release cable located in the soothing seat 100. A release cable may extend along or through one or more of the first lap strap 127, the second lap strap 129, or the crotch strap 124 and be configured to detach one or more of the first lap strap connector 137, the second lap strap connector 139, and/or the crotch strap connector 135. Since the first lap strap 127 and the second lap strap 129 are biased by the biasing members 131, detachment of the first lap strap connector 137, the second lap strap connector 139, and/or the crotch strap connector 135 allows the first lap strap 127 and the second lap strap 129 to move into a retracted position and away from the sleep safe area of the seat portion 102.

Control of the position, bounce, swing, or sway of the convertible soothing seat described herein may be implemented by a computer program. The computer program may include computer executable code or instructions arranged to instruct a computer to control the convertible soothing seat described above. The computer program and/or the code or instructions for performing such methods may be provided to an apparatus, such as a computer, a smartphone, a tablet, on a computer readable medium or computer program product. The computer readable medium could be, for example, an electronic, magnetic, optical, electromagnetic, infrared, or semiconductor system, or a propagation medium for data transmission, for example for downloading the code over the Internet. Alternatively, the computer readable medium could take the form of a physical computer readable medium such as semiconductor or solid-state memory, magnetic tape, a removable computer diskette, a random-access memory (RAM), a read-only memory (ROM), a rigid magnetic disc, and an optical disk, such as a CD-ROM, CD-R/W or DVD. The computer program may be controllable by one or more user inputs including but not limited to keyboard, electromechanical switches, a mouse, a trackball, a touchscreen, gesture control or voice command via a microphone.

In the application, the words infant and baby have been used interchangeably where appropriate. The skilled person will appreciate that the words infant and baby both refer to a young human child and may be used in place of one another where this does not lead to confusion. Herein, where the term "concave" is used, the skilled person will appreciate that concave takes the opposite meaning to convex. The term "concave" is intended to refer to any inwardly curved or angled surface such that the interior of the surface includes re-entrant geometry. This may include curves and/or reflex angles.

What is claimed is:

1. A convertible soothing seat for an infant, comprising:

a support frame;

a seat portion pivotably connected to the support frame, wherein the seat portion is configured to pivot relative to the support frame between a first configuration and a second configuration, wherein the seat portion comprises a bottom support portion and a back rest portion pivotably coupled to one another such that the back rest portion is configured to rotate relative to the bottom support portion between a flat configuration and a bowed configuration that provides a concave surface, and wherein the seat portion is configured to transition from the bowed configuration to the flat configuration in response to the seat portion pivoting from the first configuration to the second configuration; and a retractable harness comprising a lap strap extending laterally across the seat portion and movably coupled to a side edge of the seat portion and movable between a covering position and a retracted position, wherein in the covering position the lap strap covers a seat part of the seat portion, and in the retracted position, the lap strap does not cover the seat part of the seat portion.

2. The convertible soothing seat of claim 1, wherein the seat portion comprises a support and a membrane stretched over the support.

3. The convertible soothing seat of claim 2, wherein the seat portion further comprises:

a tensioner configured to tension the membrane in a flat configuration wherein the membrane is held flat by the tension, and wherein the tensioner is configured to release the membrane in a bowed configuration wherein the membrane is configured to conform to the shape of the support; or a support actuating element configured to actuate the support between a first position, in which the membrane is held flat by conforming to the supports and a second position, the second position being further from the membrane than in the first position, in which the membrane is configured to flex to a concave shape.

4. The convertible soothing seat of claim 1, wherein the seat portion is configured to transition from the flat configuration to the bowed configuration in response to the seat portion pivoting from the second configuration to the first configuration.

5. The convertible soothing seat of claim 1, wherein the seat portion comprises a handle, such that the seat portion is configured to be manually pivoted between the first configuration and the second configuration.

6. The convertible soothing seat of claim 1, wherein in the first configuration the seat portion is inclined, and in the second configuration the seat portion is substantially horizontal with respect to the support frame.

7. The convertible soothing seat of claim 1, wherein the seat portion further comprises at least one sidewall.

8. The convertible soothing seat of claim 1, wherein the seat portion comprises a sidewall which extends about a circumference of the seat portion.

9. The convertible soothing seat of claim 7, wherein the sidewall is movable between a lowered position and a raised position, wherein the sidewall extends a greater distance above the seat portion in the raised position than in the lowered position.

10. The convertible soothing seat of claim 7, wherein the sidewall comprises a rim and a sidesheet, and wherein the sidesheet is stowed in or under the rim such that the rim may contain or cover a portion of the sidesheet.

11. The convertible soothing seat of claim 1, wherein the seat portion is lockable in at least one of the first configuration and the second configuration such that when the seat portion is locked it is prevented from pivoting between the first configuration and the second configuration.

12. The convertible soothing seat of claim 1, wherein the soothing seat comprises an actuator coupled to the seat portion and configured to actuate the seat portion between the first configuration and the second configuration.

13. The convertible soothing seat of claim 12, wherein the actuator comprises one or more of an electric motor, a drive screw, a pneumatic actuator, or a hydraulic actuator.

14. The convertible soothing seat of claim 12, further comprising a controller coupled to the actuator and configured to control actuation of the seat portion between the first configuration and the second configuration in response to an input.

15. The convertible soothing seat of claim 14, wherein the input comprises one or more of a monitoring condition of the seat portion from a camera, a movement sensor, a weight sensor, a microphone, and/or a temperature sensor, a time condition, or a user controlled input.

16. The convertible soothing seat of claim 1, wherein in the first configuration and the second configuration the seat portion extends away from the support frame, and wherein the convertible soothing seat is further configured to be actuated to a storage and transport configuration in which the seat portion is collapsed with the support frame.

17. The convertible soothing seat of claim 1, wherein the seat portion is configured to pivot between a first configuration and a second configuration without removing the infant from the seat portion in use.

18. The convertible soothing seat of claim 1, further comprising an electronic communication module configured to communicate with a connected device to control operation of the convertible soothing seat.

19. The convertible soothing seat of claim 18, wherein the electronic communication module is one of a wireless communication protocol module, a Bluetooth module, a wifi module, a wired communication protocol module, or a usb module and the connected device is one of a smartphone, a tablet, or a personal computer.

20. The convertible soothing seat of claim 1, wherein the seat portion is lockable at one or more intermediate angles between a first angle in which the seat portion is in the first configuration and a second angle in which the seat portion is in the second configuration.

21. The convertible soothing seat of claim 1, wherein the harness is configured to slide towards a bottom edge of the seat portion in the retracted position.

22. The convertible soothing seat of claim 1, wherein the seat portion comprises:

a concave support configured to receive the infant;

a membrane stretched over the concave support; and a tensioner configured to tension the membrane in a flat configuration where the membrane is held flat by the tension, wherein the tensioner is configured to release the membrane in a bowed configuration where the membrane is configured to conform to the shape of the concave support.

23. The convertible soothing seat of claim 1, wherein the seat portion comprises:

a flat support configured to receive the infant;

a membrane stretched over the flat support; and a support actuating element configured to actuate the flat support between a first position, in which the membrane is held flat by conforming to the flat support, and a second position, the second position being further from the membrane than in the first position, in which the membrane is configured to flex to a concave shape.

24. The convertible soothing seat of claim 1, wherein, in the second configuration, seat portion provides a flat horizontal sleeping surface.

* * * * *